United States Patent [19]

Miller et al.

[11] 4,060,935

[45] Dec. 6, 1977

[54] REVOLVING DOOR WITH SECURITY LOCKING MECHANISM

[75] Inventors: Larry J. Miller; Marion V. Miller, both of Reed City; Richard E. Liebetrau, Cadillac, all of Mich.

[73] Assignee: Swiss Aluminium Limited, Switzerland

[21] Appl. No.: 761,674

[22] Filed: Jan. 24, 1977

[51] Int. Cl.[2] ..... E05F 15/20; E05D 15/02

[52] U.S. Cl. ..... 49/25; 49/42; 49/383

[58] Field of Search ..... 49/42, 43, 44, 45, 46, 49/47, 25, 31, 488, 489, 383; 109/8

[56] References Cited

U.S. PATENT DOCUMENTS

| | | | |
|---|---|---|---|
| 902,982 | 11/1908 | Maier | 49/45 |
| 2,055,828 | 9/1936 | Shields | 49/44 |
| 2,331,340 | 10/1943 | Mosher | 49/383 |
| 2,341,545 | 2/1944 | Hagenbook | 49/42 |
| 2,511,793 | 6/1950 | Telbizoff | 49/43 X |
| 3,285,209 | 11/1966 | Pace | 49/42 X |
| 3,903,996 | 9/1975 | Berkovitz et al. | 49/25 X |

*Primary Examiner*—Philip C. Kannan

*Attorney, Agent, or Firm*—Robert H. Bachman; Robert A. Dawson

[57] ABSTRACT

A revolving door assembly comprising a cylindrical vertically extended door housing, a vertically mounted door comprising a plurality of radially extended leaves connected to a central axis, and a canopy mounted above said door and integral with said housing, said canopy having mounted therein a linearly elongated radiant energy emitting device providing a rectangular, planar energy field, said device mounted in radial relation to the axis of said door and adapted upon the interruption of any portion of the energy field thereof to actuate the locking of said door in position whereby escape from a portion of said housing is prevented.

11 Claims, 6 Drawing Figures

REVOLVING DOOR WITH SECURITY LOCKING MECHANISM

BACKGROUND OF THE INVENTION

This invention relates generally to revolving doors, and particularly to revolving doors having electronically actuated locking mechanisms.

Recently, the provision of revolving doors in areas requiring high security has come under close scrutiny. Specifically, the advent of airline hijackings and the like has resulted in a concentration of effort in the area of security and detection. In this connection, doors presently employed in major airports are inadequately equipped to prevent the ingress of unauthorized individuals and the dangerous articles they may carry. Thus, the doors as employed in the present airport security system must be closely guarded despite the fact that passage is restricted to one direction and various alarm mechanisms are installed therein. For example, one could fasten a gun or explosive device to the glass of a revolving door leaf so as to escape the detector built into the door housing.

As the problems attending the provisions of such security devices are quite unique and urgent, the present invention is believed to derive substantial importance.

SUMMARY OF THE INVENTION

The present invention involves a revolving door assembly comprising a vertically extended cylindrical door housing, a revolving door comprising a plurality of vertically mounted, radially extended door leaves connected to a central axis and rotatable thereon, a canopy mounted above said door and integral with said housing, which may be of generally circular shape, said canopy having mounted therein a linearly elongated radiant energy emitting device providing a rectangular, planar energy field, said device mounted in radial relation to the axis of said door and adapted upon the interruption of any portion of the energy field thereof to actuate the locking of said door in position whereby passage of man or objects is prevented.

The door assembly of the present invention is freely rotatable, and may be speed-controlled by the adjustment of a hydraulically actuated brake mechanism mounted within said canopy, eccentric to the axis of said door, and connected by a mechanical drive. Further, the door housing is modified by the provision of a safety lip at the entry opening thereof on the vertical edge of said opening closest to the corridor of travel. Also, the exit opening located diametrically opposed to said entry is provided at the edge thereof closest to said energy emitting device with a wall extension integral therewith extending arcuately in the horizontal dimension so as to urge persons exiting said door to bear away from said energy emitting device.

The revolving door assembly is so designed as to prevent substantially all unauthorized intrusions therethrough, as the radiant energy field provided thereby covers the entire area described by the door leaves. Further, the provision of the lip or extension on the entry side and the wall extension on the exit side provide further safety and deterrence which are believed to minimize the accidental actuation of the mechanism.

Accordingly, it is a principal object of the present invention to provide a revolving door assembly which employs a locking mechanism conferring a reliable level of security.

It is a further object of the present invention to provide a revolving door assembly as aforesaid which requires reduced maintenance, and inspection.

It is yet a further object of the present invention to provide a revolving door assembly as aforesaid which employs a security locking mechanism capable of eliminating passage through or intrusion through the assembly.

It is yet a further object of the present invention to provide a revolving door assembly as aforesaid of a design providing improved safety and reliability.

Further objects and advantages will appear from a consideration of the description which follows in relation to the following accompanying drawings.

DETAILED DESCRIPTION

Figure 1:
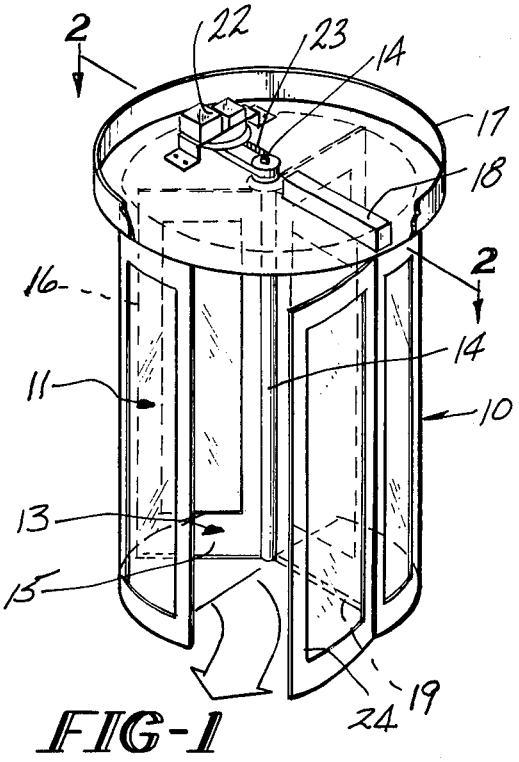
FIG. 1 is a perspective view of the revolving door assembly of the present invention.

Referring now to the drawings, wherein like numerals designate like parts, FIG. 1 comprises a perspective view of a revolving door assembly in accordance with the present invention. Assembly 10 is thus seen to comprise a generally vertically extended door housing 11 defining in the vertical plane a cylindrical shape. Door housing 11 is conventionally prepared from a plurality of curved panels comprising glass panes placed in metal framework. As the present invention relates to a door assembly intended for security applications, housing 11 may employ impact resistant materials such as bullet proof glass or appropriate metals. Housing 11 conventionally defines a pair of diametrically opposed, vertically extending openings 12 and 12' (see FIG. 3) which permit the passage of traffic through the assembly.

Within housing 11, door 13 is rotatably mounted which comprises central axis 14 vertically extending within the center of housing 11 and supporting a plurality of vertical leaves 15 adapted to travel in a circular path whereby the vertical distal edges thereof 16 describe an arc substantially coextensive with the cross sectional inner perimeter defined by housing 11. Though a plurality of such leaves 15 may be mounted on a given axis 14, the illustrations employed in accordance with the present disclosure are limited for simplicity to the provision of three leaves. It should be understood, however, that the invention is not limited thereto.

The door assembly as described thus far is operated by the exertion of force in a direction transverse to the plane of a leaf of the door by an incoming passenger, whereby the rotation of the door is set in motion enabling passage through the door housing. In this connection, a hydraulically actuated speed control device employing a braking mechanism approximating a magnetic brake assembly is mounted in rotational association with the axis of the door and provides locking resistance to rotational movement of the door leaves within the housing. The location of the brake assembly and the provision of the movement arresting means provided in accordance with the present invention will be discussed in greater detail hereinbelow.

Figure 2:
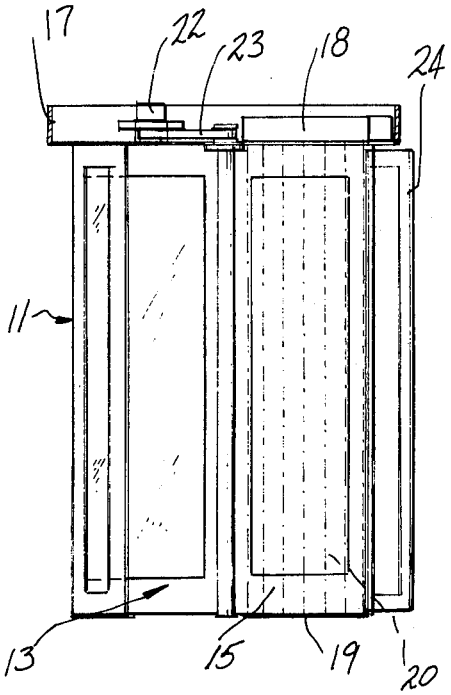
FIG. 2 is a sectional view taken through line 2—2 in FIG. 1.
Figure 3:
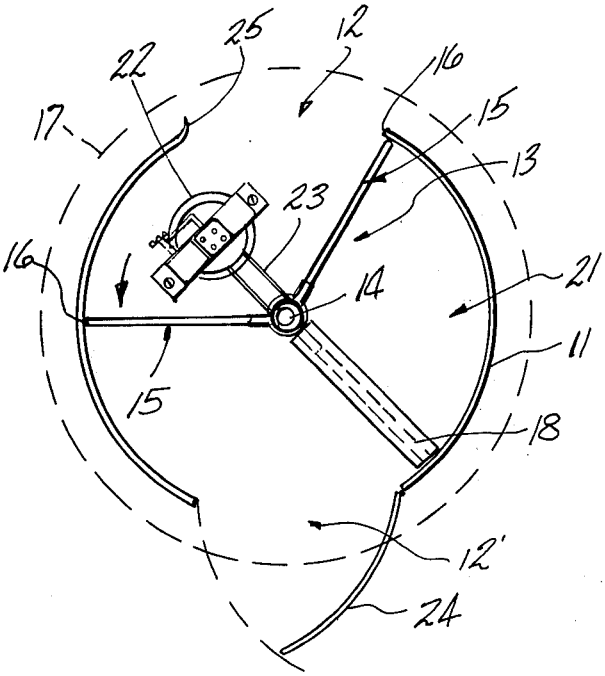
FIG. 3 is a top view partly in phantom illustrating the shape of the door housing of the present invention and the disposition of the energy emitting device and the brake mechanism in the canopy section thereof.
Figure 4:
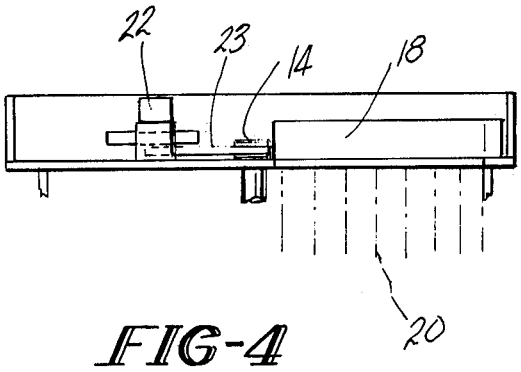
FIG. 4 is a side sectional view further illustrating the mounting of the brake mechanism and the energy emitting device in the canopy of the present invention.

Referring now to FIGS. 2–4, the door assembly of the present invention further comprises a substantially circular canopy 17 mounted above door 13, integral with door housing 11 and in overlapping relation thereto. It can be appreciated that the illustrations presented in the accompanying drawings all relate to a substantially circular canopy, however, the invention is clearly not limited thereto, as canopies possessing perimeters of varying shape may be employed in conjunction with the requirements of a given installation of the door assembly. Canopy 17 is provided in relatively overlapping relation to housing 11 to enable the mounting of the means for controlling and arresting movement of door 13 comprising a radially situated, horizontally extending, generally rectangular switch or relay means comprising a linearly elongated radiant energy emitting device 18 which transmits a generally rectangular, planar energy field in a vertically downward direction to a rectangularly extending receptor means 19 located in the same vertical plane as said emitting device and directly therebelow. Receptor means 19 comprises a mating reflector plate which permits light energy emanating from device 18 to reflect directly back thereto, whereby interruption of said reflection at any point in the path thereof will result in the transmission of an electronic impulse resulting in the activation of a mechanism which will cause door 13 to lock in the position illustrated in FIG. 3 within an arc equivalent to that described between any two door leaves 15. Thus, for example, in the present illustrations wherein the angle between leaves 15 comprises 120°, doors would not be permitted to rotate after the stimulation of device 18 by intrusion into the energy field emitted thereby.

The energy field illustrated by parallel broken lines in FIG. 2 and labeled 20 therein, comprises, as noted above, a planar "sheet" of energy traveling in the vertical dimension which describes an area equivalent to that described by the broad surface of a door leaf 15. The provision of canopy 17 in overlapping relation to housing 11 is important as it permits the installation of device 18 whereby energy field 20 may fully cover the aforenoted area. It is therefore apparent that any intrusion into field 20, which is strategically placed so as to fully obstruct entry into the prohibited area of passage labeled 21 as shown in FIG. 3, will result in the activation of a locking mechanism, discussed in detail hereinafter, which will result in the cessation of movement of door 13 in the position illustrated in FIG. 3 blocking ingress and egress in relation to area 21. It should be appreciated from the illustration that the door assembly of the present invention contemplates passage therethrough in only one direction, so that movement, in this case, counterclockwise of door 13 is intended to exclude entry into the aforenoted area labeled 21. The exact location of device 18 in relation to area 21 may vary somewhat within the scope of the present invention in relation to the direction of rotation of door 13, the number of leaves 15 provided thereon, and other similar factors of design and installation. The present invention, however, is intended to comprise the provision of device 18 whereby energy field 20 fully obstructs entry into a prohibited area in the manner shown and described herein. Further, the top vertical edges of leaves 15 are provided with appropriate reflective material thereon, not shown, which prevents the interruption of energy field 20 during the passage of leaves 15 therethrough.

Referring further to the figures and particularly to FIGS. 2–4, energy emitting device 18 is illustrated in mounted relationship with respect to axis 14 of door 13. As noted earlier a means for controlling and arresting the movement of door 13 is employed which is in rotational association with axis 14 and mounted in canopy 17. Thus, electrically actuated brake and hydraulic speed control 22 is located in off-set eccentric relation to axis 14 whereby rotational association therebetween is achieved through a mechanical drive 23 connecting respective gears or the like located on control 22 and the adjacent end of axis 14. When door 13 is rotated, control 22 is hydraulically controlled to provide resistance to rotation by the movement of fluid which causes door 13 to rotate at a constant rate despite possible fluctuations in motor force applied against leaves 15. In the event that energy field 20 is interrupted, a signal is sent to an electronic relay device, not shown, which activates a brake mechanism causing the locking of door 13 in the aforenoted position as illustrated in FIG. 3.

The particular brake and speed control employed in the present invention is of a unique design requiring a minimum of movable parts located primarily about a central axis. The placement of control 22 in a position eccentric to axis 14 comprises a feature of the present invention, as it permits the placement of device 19 in fully extensive radial relation enabling field 20 to cover the full area described by a door leaf 15. Control 22, as noted earlier, is operably connected to axis 14 by a mechanical drive 23 extending between respective pulleys or gears, or other apparatus.

The door assembly of the present invention possesses additional significant structural features which complement the provision of the radiant energy emitting device 18. Specifically, referring to FIG. 3, comprising a top view of the assembly of the present invention, door housing 11 is seen to include a radially outwardly extended, vertical, planar wall member 24, located on the portion of housing 11 adjacent the placement of device 18. Wall member 24 is provided to encourage the movement of traffic passing through exiting opening 12', away from the location of device 18 and the possible accidental interference with energy field 20. Thus, traffic approaching exit opening 12' is urged by the direction and placement of wall member 24 to bear away from the location of field 20, and potential intruders are forced into direct confrontation with exiting traffic in a more confined area during any attempt to secure passage through prohibited area 21.

In addition to the provision of wall member 24, housing 11 is modified at the entry side thereof, the entry opening 12 by the provision of a lip-like extension 25 on the vertical edge of housing 11 lying opposed to the direction of travel of door 13. Thus, in FIG. 3, extension 25 is seen to reside at a vertical edge of housing 11 directly opposed to the line of travel of the vertical distal edges 16 of leaves 15 after their passage through entry opening 12. Extension 25 is provided as a safety measure to minimize personal injury resulting from the inadvertent entrapment of passengers' fingers accidentally gripping the leading edge of housing 11 during entry into door assembly 10. Extension 25 is shown in FIG. 3 in accentuated form, but may comprise the rounding of an inwardly directed leading edge of housing 11 at the above-indicated location.

Figure 6:
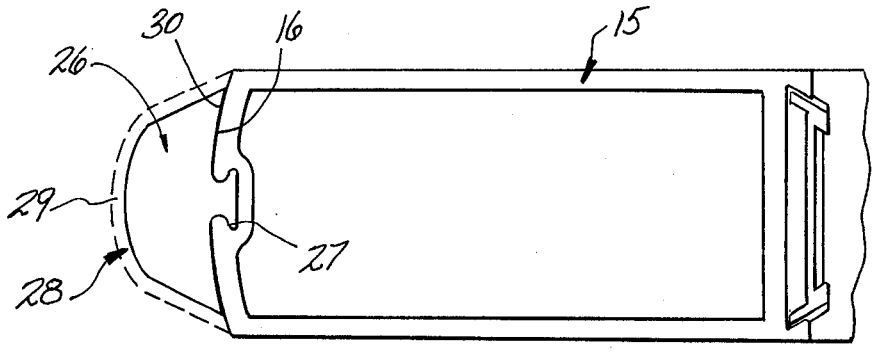
FIG. 6 is a top view partly in section illustrating the gasket employed on the distal vertical edging of the door leaves employed in the present invention.

In addition to the provision of extension 25, the door assembly of the present invention possesses a further feature which is considered to provide additional safety to door passengers. Referring to FIG. 6, each of the vertical distal edges 16 of respective door leaves 15 is provided with a continuous gasket 26 fastened to edge 16 in an interlocking tongue-in-groove relationship 27. Gasket 26 is prepared from a resilient foam material provided at its outer surfaces 28 with a continuous skin. Gasket 26 is of a unique design substantially frustoconical in shape and characterized by a relatively flat, broad leading edge 29 which tapers out to a base section 30 comprising in breadth substantially the entire width of edge 16. The design and construction of gasket 26 enables sufficient resilience to prevent damage to objects, including human fingers accidentally lodging between the interior wall of housing 11 and vertical edge 16 of leaf 15. The combination of gasket 26 and extension 25 serves to substantially reduce the incidence of injury occurring at the entry opening 12 of the door assembly of the present invention, and thus comprises a substantial improvement in the safety afforded by its use.

Figure 5:
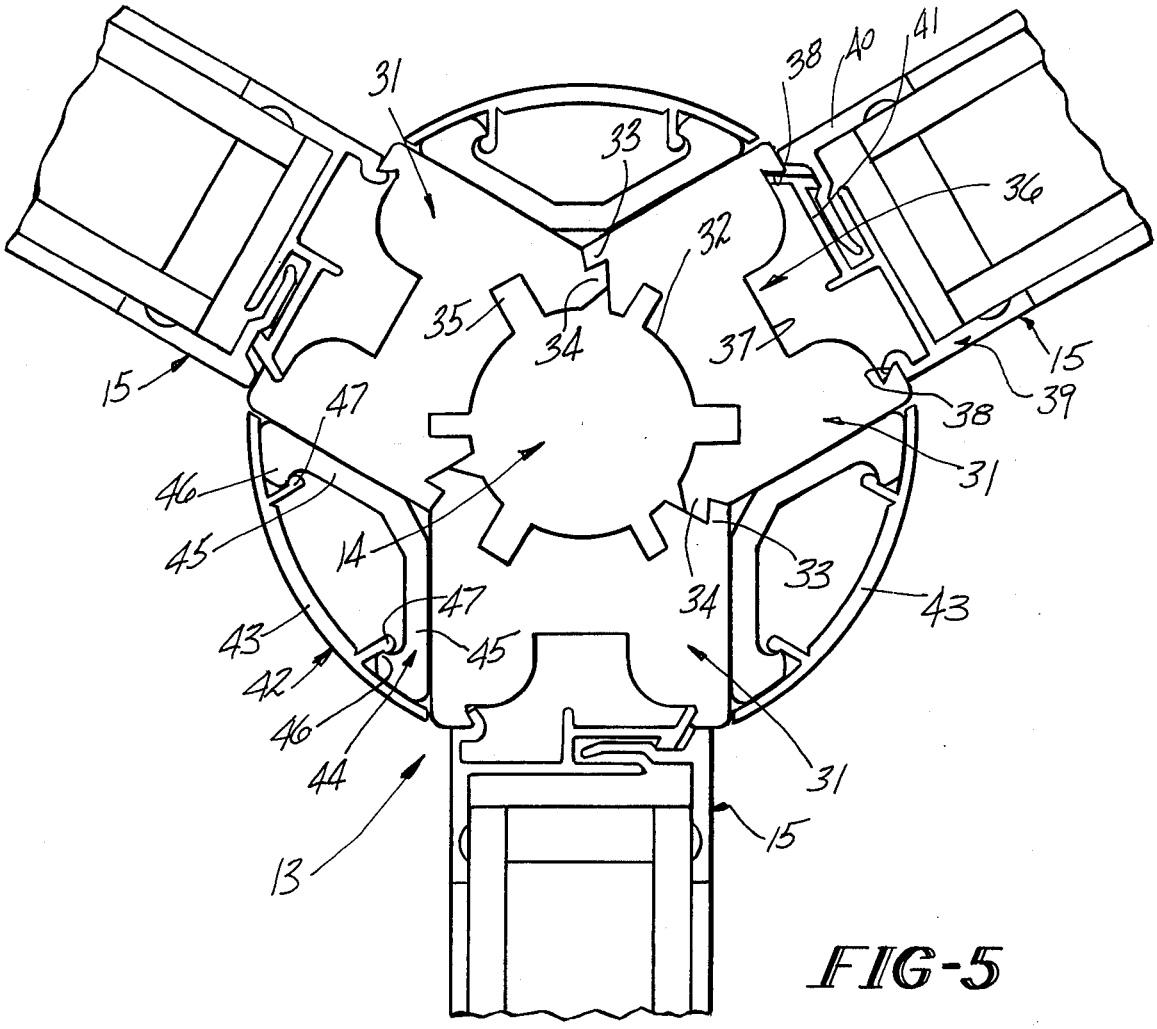
FIG. 5 is a top view partly in section illustrating the door leaf support assembly employed in accordance with the present invention.

As noted earlier, the door assembly of the present invention incorporates several features which render it distinctive and advantageous over assemblies employed and presently known in the prior art. Thus, in addition to the security conferred by the use of a uniquely placed energy emitting device and the safety conferred by the provision of the lip-like extension provided on the housing and the gasket provided on the edge of the door leaves, there is a further advantage comprising an economy and ease of assembly and maintanence of the door itself. Referring now to FIG. 5, door 13 is depicted in a horizontal end view partly in section, and is seen to comprise a plurality of door leaves 15, as noted before, operatively connected to an axis 14 for rotation therearound. In conventional door assemblies, the leaves were generally affixed to the axis by a coupling member which fastened directly thereto and which required that the door be assembled before final installation in the housing. By contrast, the door of the present invention permits the assembly of the coupling members to the axis at the site of installation in such a manner that the door leaves may thereafter be attached thereto and may likewise be easily removed therefrom in the event that repair or dismantling of the door is desired. Specifically, FIG. 5 illustrates a plurality of such coupling members comprising rails 31 comprising linearly elongated extrusions defining substantially rectangular cross sections, attached on one side thereof for interlocking association with the mating vertical proximal edges of leaves 15, and that the opposite side thereof defining a concave surface 32 describing an arc complementary and coextensive with a portion of the cross section perimeter of axis 14. Concave surfaces 32 terminate at the lateral ends thereof in projections 33 and 34 and grooves 35. Projections 33 and 34 are, as illustrated, attached to mate in a locking relationship with adjacent projections to define, in full assembly, a complete, encircling enclosure of axis 14. Final fastening of rails 31 to axis 14 is achieved by direct screw engagement through holes, not shown, placed in track 36, discussed hereinbelow.

The design of interlocking rails 31 confers the additional advantage of increased strength to door 13, in that the operative interlocking relationship provided between the respective rails serves to absorb a portion of the torsional stress imposed upon the junction of the door leaf and the axis by the force exerted on the leaf in the operation of the door. This improved distribution of stress throughout the structure of the door serves to decrease the incidence of the breakdown and repair thereof, and thus renders the door more economical to install and operate.

As noted above, the rails employed as coupling members in the door of the present invention confer an ease of assembly which is not found in doors of the prior art. Referring again to FIG. 5, rails 31 are provided on the surfaces distal to axis 14 with an indentation or track 36 comprising a primary indentation 37 located centrally therein and a pair of laterally opposed secondary indentations 38 located adjacent the lateral edges of track 36. Secondary edges 38 are adapted to snap-fittably interlock with glazing members 39 and 40 and bracket assembly 41.

In addition to the construction outlined above, door 13 defines an additional feature which possesses both a cosmetic and a functional advantage. Referring further to FIG. 5, an arcuate facing member 42 is provided in interstitial relation to respective rails 31 whereby the overall cross sectional perimeter defined by the coupling assembly comprising rails 31 and facings 42 is circular in shape. Facing 42 is comprised of vertically extended, arcuate facing sheet 43 adapted for snap-fittable mounting adjacent rails 31 upon V-shaped retainer 44. Retainer 44 is attached to adjacent rails 31 by screw fasteners, not shown, which are driven through the respective legs 45 thereof. Legs 45 are provided, at their distal ends with laterally opposed ridges 46 which serve to engage corresponding protrusions 47 provided on the concave surface of facing sheet 43. Upon installation, facing 42 serves to provide a streamlined appearance to the interior of door 13 and, further, radially extends the perimeter of the coupling assembly about axis 14 into coextensive abutting relationship with field 20, so that dangerous objections may not be secured adjacent rails 31 in a manner which would escape detection by field 20. This latter measure is necessitated by the size of device 18 which renders it difficult to locate adjacent axis 14 in a manner which will provide sufficient room for a pulley or gear to protrude for connection via mechanical drive 23 to control 22. The limitations imposed by the above-described spatial arrangement can better be visualized by reference to FIG. 4, wherein the placement of device 18 and the area resultingly covered by field 20 are schematically depicted.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a revolving door assembly comprising a generally cylindrical, vertically extending door housing, said door housing defining diametrically opposed vertically extending openings therein, a vertically mounted door comprising a central axis and at least two radially extending door leaves connected thereto, said door leaves adapted for rotation about said axis, and a canopy mounted above said door in overlapping relation to said door housing, said canopy containing means for controlling and arresting the movement of said door comprising a linearly elongated radiant energy emitting device adapted to provide a generally rectangular, planar energy field, said field of equal displacement to one of said leaves and extending in the vertical plane, said energy emitting device mounted in radial relation to the axis of said revolving door whereby said energy field abuts at one end thereof with said axis and at the opposite end thereof with a vertical edge of one of said openings, said energy emitting device adapted upon the interruption of any portion of said energy field by a foreign object to actuate the locking of said revolving door in fixed position, whereby passage of man or objects is prevented, wherein said door leaves define upper horizontal edges passing adjacent said canopy, said upper horizontal edges provided with surfaces reflective to said energy field whereby the interruption of said field during the passage therethrough of said leaves is prevented.

2. The assembly of claim 1 wherein said energy emitting device comprises a rectangularly extending receptor means located in the same vertical plane as said device and mounted below the level of said door.

3. The assembly of claim 1 wherein said door housing includes a radially outwardly extended vertical, curved planar wall member continuous with said housing at a location adjacent to said energy emitting device.

4. The assembly of claim 1 wherein said door housing comprises a lip-like extension of a vertical edge thereof adjacent the entry opening of said housing and opposed to the direction of travel of said door.

5. The assembly of claim 1 wherein said controlling and arresting means further includes locking means comprising an electrically actuated brake.

6. The assembly of claim 5 wherein said brake and speed control is mounted in said canopy in eccentric relation to said axis.

7. The assembly of claim 6 wherein said brake and speed control is operatively connected to said axis in mechanical-driven relationship thereto.

8. The assembly of claim 1 wherein said door leaves are provided on the vertical distal edges thereof with a continuous gasket of substantially frustoconical cross section defining a broad leading edge for contact with the interior of said door housing.

9. The assembly of claim 8 wherein said gasket is prepared from a resilient foam material possessing a continuous outer skin.

10. The assembly of claim 1 wherein said door comprises a plurality of door leaves situated in a mounted relation to said axis by engagement with a plurality of laterally interlocking linearly elongated coupling members associated in surrounding, fastened relationship to said axis.

11. The assembly of claim 10 wherein said coupling members comprise extrusions of substantially rectangular cross section defining on one side thereof concave surfaces complementary with the cross sectional perimeter of said axis for fastening thereagainst, and on the other side thereof concave surfaces adapted to engage said leaves.

* * * * *